US007652426B2

(12) United States Patent
Jeong

(10) Patent No.: US 7,652,426 B2
(45) Date of Patent: Jan. 26, 2010

(54) PLASMA DISPLAY PANEL

(75) Inventor: Seong-Joon Jeong, Yongin-si (KR)

(73) Assignee: Samsung SDI Co., Ltd., Suwon-Si, Gyeonggi-do (KR)

( * ) Notice: Subject to any disclaimer, the term of this patent is extended or adjusted under 35 U.S.C. 154(b) by 467 days.

(21) Appl. No.: 11/592,822

(22) Filed: Nov. 3, 2006

(65) Prior Publication Data

US 2007/0103073 A1 May 10, 2007

(30) Foreign Application Priority Data

Nov. 8, 2005 (KR) ..... 10-2005-0106350

(51) Int. Cl.
*H01J 17/49* (2006.01)

(52) U.S. Cl. ..... 313/582; 313/585; 313/586

(58) Field of Classification Search ..... 313/582–587; 345/37, 41, 60, 71

See application file for complete search history.

(56) References Cited

U.S. PATENT DOCUMENTS

| | | | | |
|---|---|---|---|---|
| 6,597,124 | B2 | 7/2003 | Park et al. | |
| 6,713,959 | B1 * | 3/2004 | Toyoda et al. | 313/582 |
| 6,853,138 | B1 * | 2/2005 | Park et al. | 313/586 |
| 2001/0051585 | A1 * | 12/2001 | Ryu et al. | 501/76 |
| 2004/0248048 | A1 | 12/2004 | Lee | |

FOREIGN PATENT DOCUMENTS

| | | | | |
|---|---|---|---|---|
| JP | 09-050767 | A | | 2/1997 |
| JP | 09050767 | A | * | 2/1997 |
| JP | 2001-319578 | | | 11/2001 |
| KR | 1020010068301 | A | | 7/2001 |
| KR | 10-2001-0105473 | A | | 11/2001 |
| KR | 10-2003-0018277 | A | | 3/2003 |
| KR | 1020040104790 | A | | 12/2004 |
| WO | WO 00/74102 | A1 | | 12/2000 |

* cited by examiner

*Primary Examiner*—Peter J Macchiarolo
*Assistant Examiner*—Donald L Raleigh
(74) *Attorney, Agent, or Firm*—Knobbe Martens Olson & Bear LLP

(57) ABSTRACT

Provided is a plasma display panel that protects both substrates against distortion when assembled, and reduces a halation effect. The plasma display panel includes: a first substrate and a second substrate facing each other; address electrodes which are formed on the first substrate to extend in a first direction; barrier ribs which are disposed between the first and second substrates, and define discharge cells; phosphor layers which are formed within the discharge cells; first electrodes and second electrodes which are formed on the second substrate to extend in a second direction crossing the first direction; and a dielectric layer which covers the first electrode and the second electrode, wherein the dielectric layer includes grooves formed in correspondence with the barrier ribs, and at least portions of the barrier ribs are inserted into the grooves.

11 Claims, 8 Drawing Sheets

PLASMA DISPLAY PANEL

CROSS-REFERENCE TO RELATED APPLICATION

This application claims priority to and the benefit of Korean Patent Application No. 10-2005-0106350 filed in the Korean Intellectual Property Office on Nov. 8, 2005, the entire content of which is incorporated herein by reference.

BACKGROUND OF THE INVENTION

1. Field of the Invention

The present embodiments relate to a plasma display panel, and more particularly, to a plasma display panel that protects both substrates against distortion when assembled, and reduces a halation effect.

2. Description of the Related Art

Plasma display panels (PDPs) display an image by using a gas discharge. PDPs have excellent display capability in terms of display capacity, brightness, contrast, latent image, and viewing angle.

In a PDP, a front substrate, which has sustain electrodes and scan electrodes with barrier ribs interposed therebetween, is sealed against a rear substrate having address electrodes. The barrier ribs define discharge cells. An inert gas (e.g. neon (Ne) and xenon (Xe)) is filled in the discharge cells.

When an address voltage is supplied to the address electrodes, and a scan pulse is supplied to the scan electrodes, the PDP produces wall charges between the two electrodes, and selects the discharge cells to be turned on by an address discharge. In this state, when a sustain pulse is supplied to the sustain electrodes and the scan electrodes, electrons and ions formed in the sustain electrodes and the scan electrodes travel between the sustain electrodes and the scan electrodes. Accordingly, the address voltage is added to a wall voltage stemming from the wall charges formed by the address discharge. Thus, the address voltage exceeds a discharge ignition voltage, thereby generating a sustain discharge within the selected discharge cells.

A vacuum ultraviolet ray generated within the discharge cells by the sustain discharge excites a phosphor material. The phosphor material relaxes from an excited state, and thus generates a visible light beam. Accordingly, an image is formed on the PDP.

The PDP enables the sustain discharge to occur at a low voltage by forming and accumulating the wall charges. Further, in order to protect the sustain electrodes and the scan electrodes against discharge, the sustain electrodes and the scan electrodes provided across the entire surface of the front substrate are covered with a dielectric layer. The front substrate is sealed against the rear substrate, and thus barrier ribs included in the rear substrate are closely adhered to the dielectric layer, thereby defining the discharge cells.

When the front substrate and the rear substrate of the PDP are sealed against each other, the front substrate and the rear substrate are distorted due to a property of a sealant whose volume is reduced in the process of annealing the sealant adhering both substrates, a difference in the tension force of a clip fastening the both substrates, and a relatively large tension force of the clip at a vent side.

Moreover, a halation effect may occur in the PDP. The halation effect is defined as a blurred phenomenon that occurs when a visible light beam emitted from an emissive discharge cell passes over an adjacent non-emissive discharge cell.

SUMMARY OF THE INVENTION

The present embodiments provide a plasma display panel that protects both substrates against distortion when assembled, and reduces a halation effect.

According to the present embodiments, there is provided a plasma display panel comprising: a first substrate and a second substrate facing each other; address electrodes which are formed on the first substrate to extend in a first direction; barrier ribs which are disposed between the first and second substrates, and define discharge cells; phosphor layers which are formed within the discharge cells; first electrodes and second electrodes which are formed on the second substrate to extend in a second direction crossing the first direction; and a dielectric layer which covers the first electrode and the second electrode, wherein the dielectric layer includes grooves formed in correspondence with the barrier ribs, and at least portions of the barrier ribs are inserted into the grooves.

In the aforementioned aspect of the present embodiments, the grooves may include vertical grooves each having a depth smaller than the thickness of the dielectric layer in a thickness direction of the dielectric layer which is defined as a third direction perpendicular to the first and second directions.

In addition, the barrier ribs may extend in the first direction.

In addition, the vertical grooves may extend in the first direction.

In addition, the barrier ribs may comprise first black layers located within the vertical grooves. In addition, the first black layers may be closely adhered to the second substrate.

In addition, the grooves may include horizontal grooves each having a predetermined depth.

In addition, the barrier ribs may comprise: first barrier members extending in the first direction; and second barrier members formed between the first barrier members and extending in the second direction.

In addition, the horizontal grooves may extend in the second direction.

In addition, the barrier ribs may comprise second black layers located within the horizontal grooves. In addition, the second black layers may be closely adhered to the first substrate.

In addition, each of the horizontal grooves may have a depth equal to the thickness of the dielectric layer.

In addition, the heights of the barrier ribs may be defined in the third direction, and the heights of the second barrier members may be greater than the heights of the first barrier members.

In addition, the grooves may include: vertical grooves each having a depth smaller than the thickness of the dielectric layer in a thickness direction of the dielectric layer which is defined as a third direction perpendicular to the first and second directions; and horizontal grooves each having a depth greater than the depths of the vertical grooves.

In addition, the dielectric layer may be covered with a protective layer.

Some embodiments relate to a method of manufacturing a plasma display panel comprising providing the first and second substrate, providing the barrier ribs, providing the dielectric layer and combining the first and second substrate such that the at least one portion of the barrier ribs is inserted into the grooves of the dielectric layer.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE EMBODIMENTS

With reference to the accompanying drawings, examples of the embodiments will be described. As those skilled in the art would realize, the described embodiments may be modified in various different ways, all without departing from the spirit or scope of the present embodiments. Wherever possible, the same reference numbers will be used throughout the drawings to refer to the same or like parts.

Figure 1:
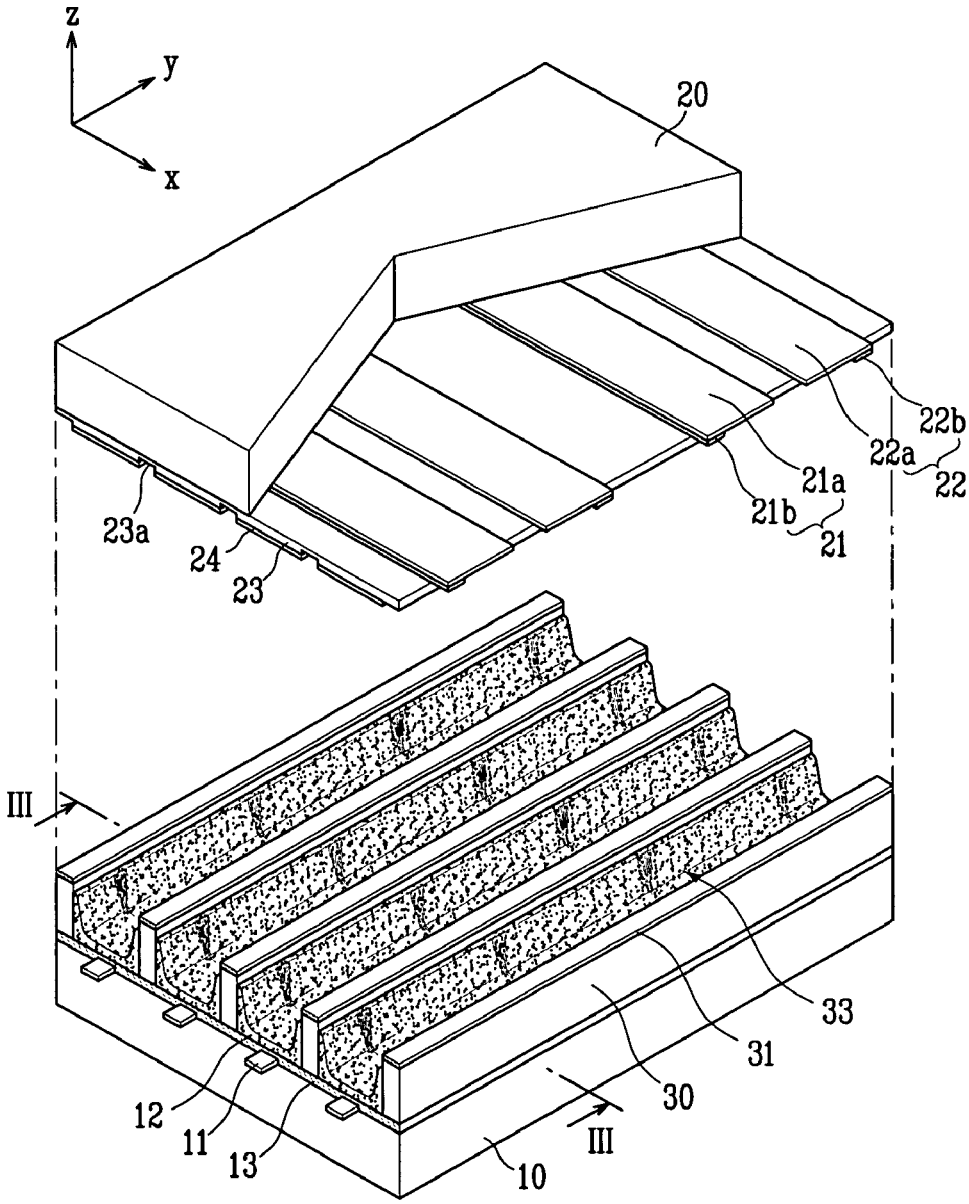
FIG. 1 is a perspective exploded view schematically showing a plasma display panel (PDP) according to a first embodiment.
Figure 2:
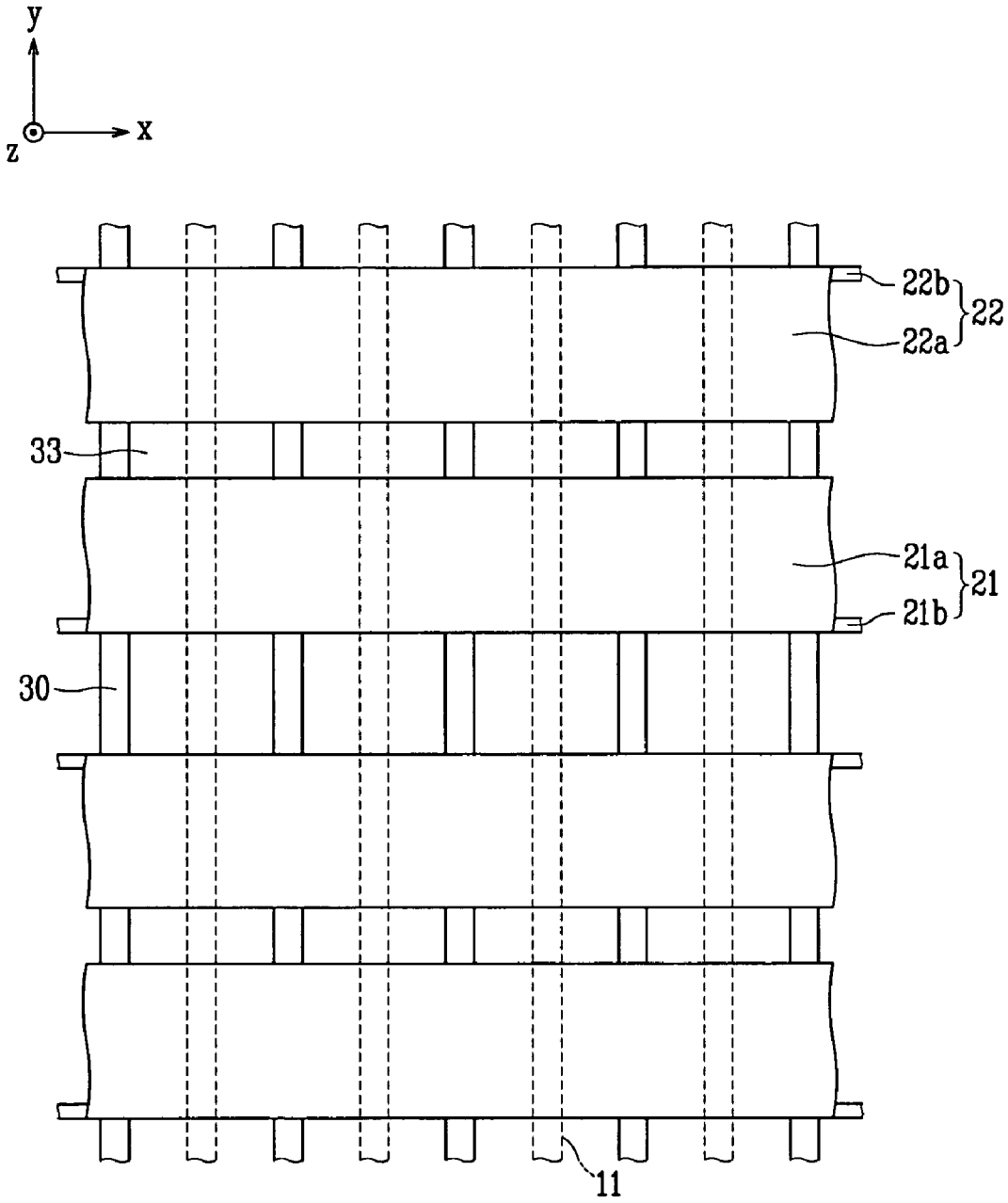
FIG. 2 is a plan view showing a layout relation between barrier ribs and electrodes of FIG. 1.
Figure 3:
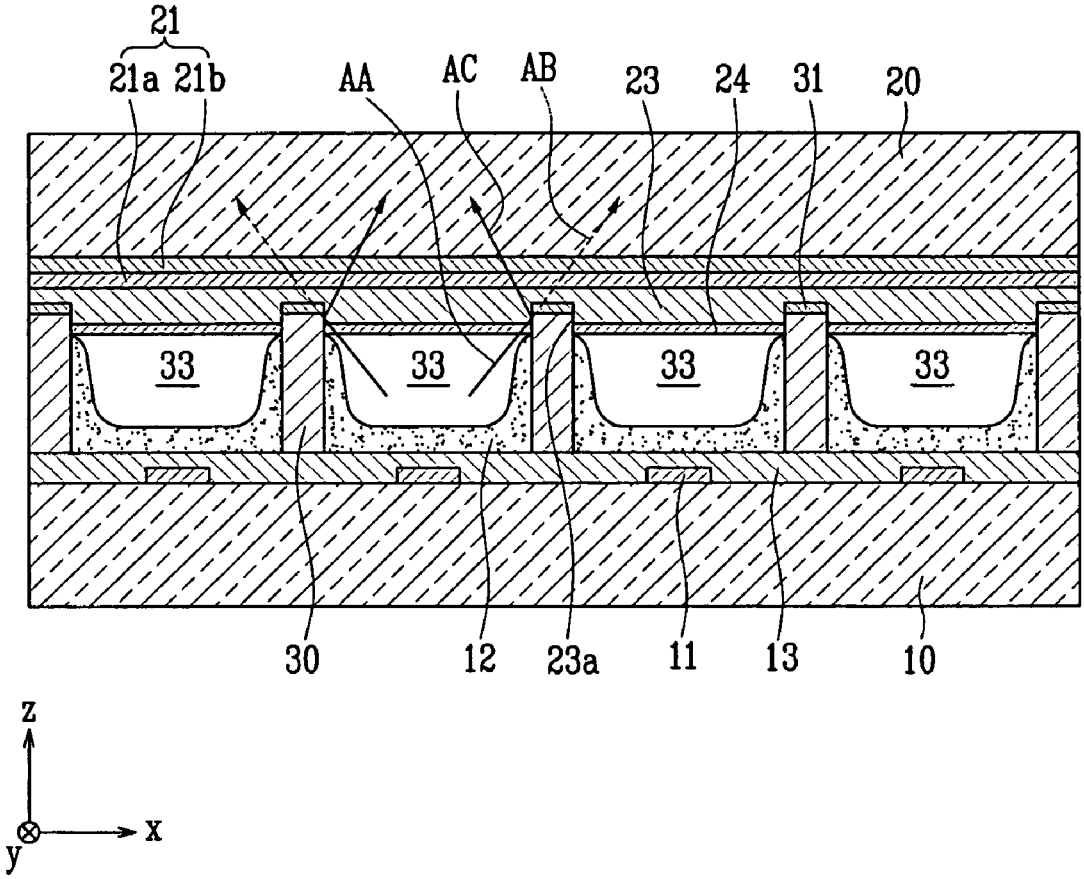
FIG. 3 is a cross-sectional view of taken along line III-III of FIG. 1.

FIG. 1 is a perspective exploded view schematically showing a plasma display panel (PDP) according to a first embodiment. FIG. 2 is a plan view showing a layout relation between barrier ribs and electrodes of FIG. 1. FIG. 3 is a cross-sectional view of taken along line III-III of FIG. 1.

Referring to these drawings, the PDP of the present embodiments includes a first substrate 10 (hereinafter referred to as a "rear substrate") and a second substrate 20 (hereinafter referred to as a "front substrate"). The two substrates 10 and 20, facing each other, are sealed against each other while being spaced apart from each other by a predetermined distance.

Barrier ribs, for example, first barrier members 30, are disposed between the rear substrate 10 and the front substrate 20, thereby defining discharge cells 33. An inert gas (for example, a mixture of neon (Ne) and xenon (Xe) gasses) that generates a vacuum ultraviolet ray during a plasma discharge is filled in the discharge cells 33.

Address electrodes 11, first electrodes 21 (hereinafter, referred to as "sustain electrodes"), and second electrodes 22 (hereinafter, referred to as "scan electrodes") are respectively disposed in correspondence with the discharge cells 33.

The address electrodes 11 are formed on the rear substrate 10 to extend in a first direction (y-axis direction in the drawing, hereinafter referred to as "y"). The plural address electrodes 11 are arranged in correspondence with the discharge cells 33 in a second direction (x-axis direction in the drawing, hereinafter referred to as "x") with a predetermined interval.

The sustain electrodes 21 and the scan electrodes 22 are formed on the front substrate 20 in the second direction x crossing the address electrodes 11. The sustain electrodes 21 and the scan electrodes 22 are respectively arranged in the first direction y in correspondence with the discharge cells 33 with a predetermined interval.

The first barrier members 30 are formed in the first direction y that is an elongation direction of the address electrodes 11. Each first barrier member 30 is disposed between the neighboring address electrodes 11, and is formed in the first direction y, parallel to the address electrodes 11. For example, the first barrier ribs 30 can form a stripe shape.

Phosphor layers 12 are formed on the first barrier ribs 30. The phosphor layers 12 may generate visible light beams of red, green, and blue due to a vacuum ultraviolet ray generated during a plasma discharge. The phosphor layers 12 are formed with the lateral sides of the first barrier members 30 forming the discharge cells 33, and a phosphor material applied on a first dielectric layer 13 surrounded by the first barrier members 30.

The first dielectric layer 13 is applied on the rear substrate 10, and buries the address electrodes 11. The first dielectric layer 13 protects the address electrodes 11 during the plasma discharge. Further, the first dielectric layer 13 forms and accumulates wall charges during an address discharge.

The sustain electrodes 21 and the scan electrodes 22 arranged on the front substrate 20 are buried such that a second dielectric layer 23 is laminated with a protective layer 24, which can be for example, a MgO protective layer. During discharge, the second dielectric layer 23 protects the sustain electrodes 21 and the scan electrodes 22, while forming and accumulating the wall charges. The protective layer 24 protects the second dielectric layer 23. During discharge, the protective layer 24 raises the secondary electron emission factor so as to reduce the discharge ignition voltage.

The rear substrate 10, which includes the address electrodes 11, the first barrier members 30, and the phosphor layers 12, can be separately manufactured from the front substrate 20, which includes the sustain electrodes 21, the scan electrodes 22, and the second dielectric layer 23. Thereafter, the two substrates 10 and 20 are combined with each other, thereby forming a PDP.

The second dielectric layer 23 formed on the front substrate 20 includes grooves, for example, vertical grooves 23*a*, in correspondence with the locations of the first barrier ribs 30. The vertical grooves 23*a* are formed long in the first direction y in which the first barrier members 30 are formed. Thus, the vertical grooves 23*a* can be joined with the first barrier members 30. The vertical grooves 23*a* are lined up in the second direction x.

Each vertical groove 23*a* has a depth less than the thickness of the second dielectric layer 23. The thickness of the second dielectric layer 23 is defined as a magnitude in a third direction (z-axis direction in the drawing) that is perpendicular to the first direction y and the second direction x. The second dielectric layer 23 buries the sustain electrodes 21 and the scan electrodes 22. Thus, it is desirable that the depth of each vertical groove 23*a* does not damage the sustain electrodes 21 and the scan electrodes 22.

Accordingly, when the rear substrate 10 and the front substrate 20 are sealed against each other, the first barrier members 30 of the rear substrate 10 are respectively inserted into the vertical grooves 23*a* formed on the second dielectric layer 23 of the front substrate 20.

A difference in the tension force of a clip (not shown) is produced in the process of sealing the rear substrate 10 and the front substrate 20. This difference is absorbed according to the depth of insertion when the first barrier members 30 are joined with the vertical grooves 23*a*. As a result, the front substrate 20 and the rear substrate 10 are not influenced by a partially different supporting force, thereby not being affected by a distortion effect.

A visible light beam is generated in one discharge cell 33 when ends of the first barrier members 30 are buried into the vertical grooves 23*a* of the second dielectric layer 23. The generated visible light beam is blocked by the first barrier members 30, and thus cannot pass over adjacent non-emissive discharge cells 33. Accordingly, a cross-talk effect and a halation effect can be effectively prevented.

Detailed description will be given with reference to FIG. 3. For example, a visible light beam AA emitted from one discharge cell 33 is blocked by the first barrier members 30, disabling its passage over the adjacent non-emissive cells 33 (indicated by AB). Then, the visible light beam AA is reflected at the first barrier members 30, and is emitted to the front substrate 20. That is, in comparison with the case that the first barrier members 30 are not inserted, the cross-talk effect and the halation effect can be further prevented according to how deep the first barrier members 30 are inserted into the vertical groove 23*a*.

The first barrier members 30 include first black layers 31 to improve contrast. When the first barrier members 30 are inserted into the vertical grooves 23*a*, the first black layers 31 are located adjacent to the front substrate 20 within the vertical grooves 23*a*. The first black layers 31 may be closely adhered to the front substrate 20 within the vertical grooves 23*a* (see FIG. 6).

The sustain electrodes 21 and the scan electrodes 22 will be described by an example. The sustain electrodes 21 and the scan electrodes 22 include transparent electrodes 21*a* and 22*a* and bus electrodes 21*b* and 22*b*, respectively. In this case, the transparent electrodes 21*a* and 22*a* produce a surface discharge within the discharge cells 33. In order to ensure an aperture ratio of the discharge cells 33, the transparent electrodes 21*a* and 22*a* may be formed of a transparent material, for example, ITO (indium tin oxide). The bus electrodes 21*b* and 22*b* ensure conductivity by compensating for high electrical resistivity of the transparent electrodes 21*a* and 22*a*. The bus electrodes 21*b* and 22*b* are formed of metal, for example, aluminum (Al). The bus electrodes 21*b* and 22*b* are formed on the transparent electrodes 21*a* and 22*a* to extend in the second direction x crossing the address electrodes 11.

In the PDP constructed as described above, an address pulse is supplied to the address electrodes 11, and a scan pulse is supplied to the scan electrodes 22. Then, an address discharge occurs in one discharge cell 33 in correspondence with the two electrodes 11 and 22 crossing each other. The discharge cells 33 to be turned on due to the address discharge are selected. Wall charges are formed within the selected discharge cells 33. Thereafter, a sustain pulse is supplied to the sustain electrodes 21 and the scan electrodes 22. As a result, a sustain discharge occurs, thereby forming an image by the selected discharge cell 33.

To achieve this, a reset pulse is supplied to the scan electrodes 22 during a rest period. During a scan period following the reset period, a scan pulse is supplied to the scan electrodes 22, and an address pulse is supplied to the address electrodes 11. During a sustain period following the scan period, a sustain pulse is supplied to the sustain electrodes 21 and the scan electrodes 22.

The sustain electrodes 21 and the scan electrodes 22 function as electrodes for supplying the sustain pulse required for the sustain discharge. The scan electrodes 22 function as electrodes for supplying the reset pulse and the scan pulse. However, the electrodes 21 and 22 may have different functions according to a waveform of voltage applied to each electrode. Therefore, the present embodiments are not limited to the above functions.

Figure 4:
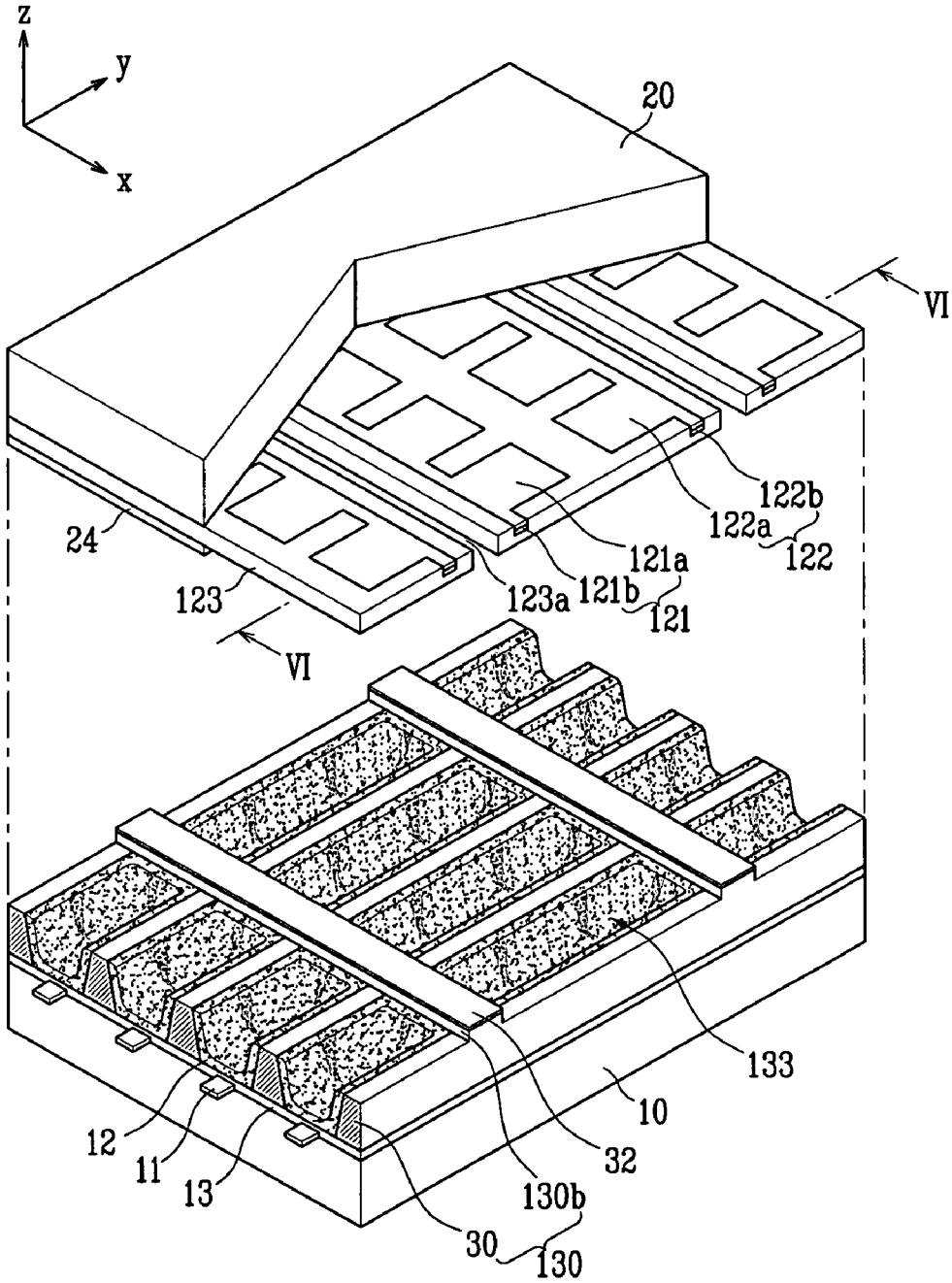
FIG. 4 is a perspective exploded view schematically showing a PDP according to a second embodiment.
Figure 5:
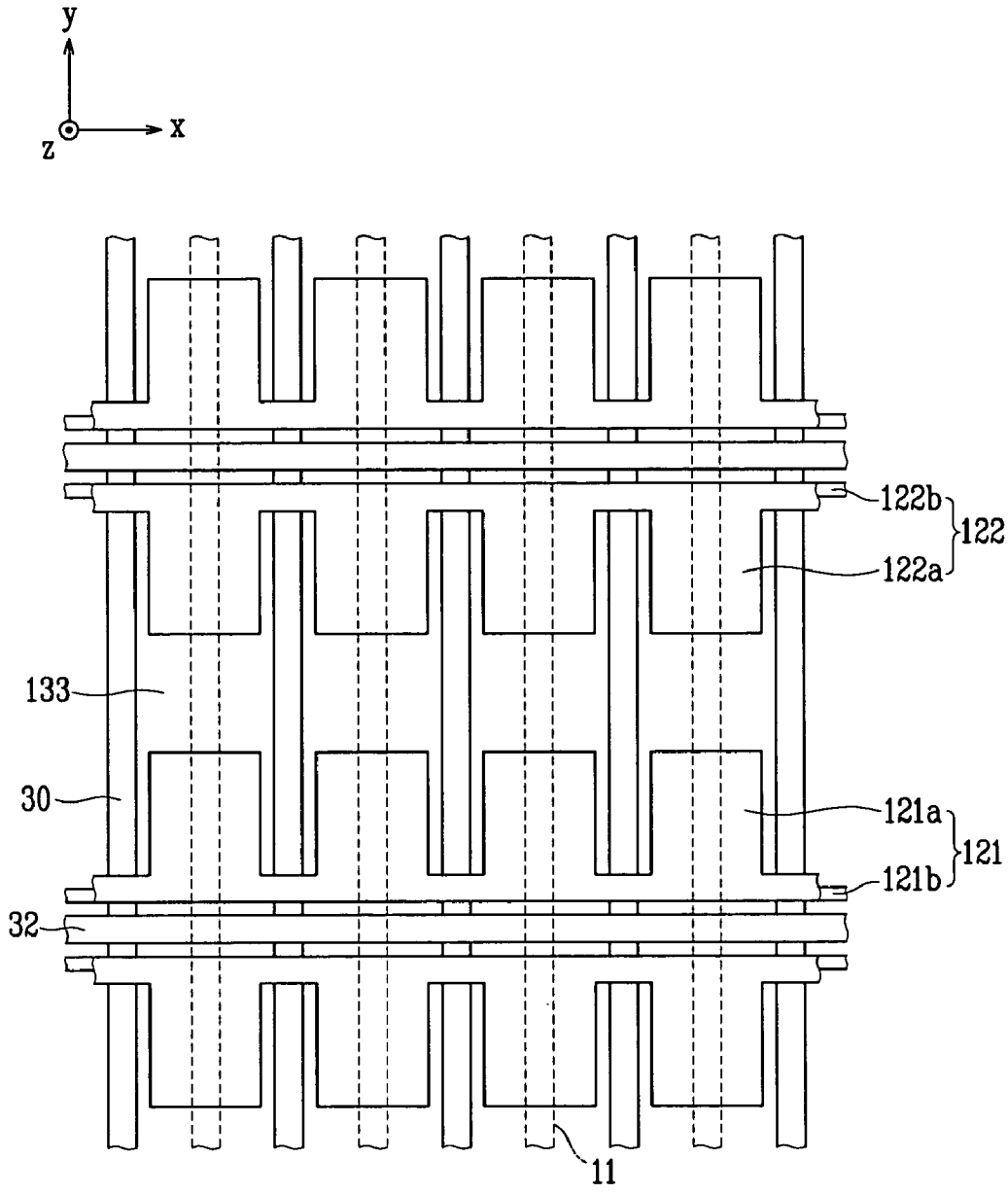
FIG. 5 is a plan view showing a layout relation between barrier ribs and electrodes of FIG. 4.
Figure 6:
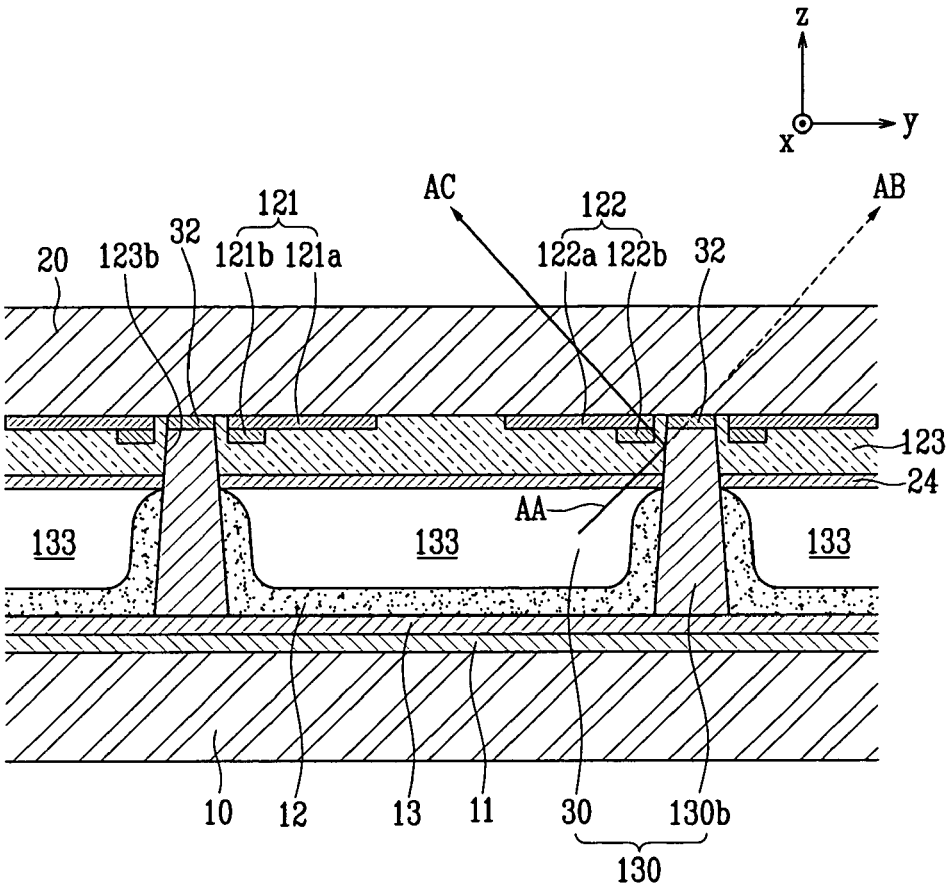
FIG. 6 is a cross-sectional view of taken along line VI-VI of FIG. 4.

FIG. 4 is a perspective exploded view schematically showing a PDP according to a second embodiment. FIG. 5 is a plan view showing a layout relation between barrier ribs and electrodes of FIG. 4. FIG. 6 is a cross-sectional view of taken along line VI-VI of FIG. 4.

Referring to these drawings, the second embodiment is similar or equivalent to the first embodiment in terms of its overall structure and operations. Thus, like elements will not be described, and only differences will be described.

In the second embodiment, barrier ribs 130 include first barrier members 30 formed in the first direction y, and second barrier members 130*b* located between neighboring first barrier members 30 and arranged in the second direction x crossing the first barrier members 30. That is, the first barrier members 30 and the second barrier members 130*b* form a matrix shape.

In comparison with the stripe-shaped example, the matrix-shaped barrier ribs 130 can further effectively prevent the cross-talk effect between discharge cells 133.

The first barrier members 30 are respectively disposed between the neighboring address electrodes 11, and are substantially parallel to the address electrodes 11.

The second barrier members 130*b* are respectively arranged in correspondence with scan electrodes 121 and sustain electrodes 122 disposed in pair. The second barrier members 130*b* are formed in the second direction x crossing the address electrodes 11. Transparent electrodes 121*a* and 122*a* of the sustain electrodes 121 and the scan electrodes 122, respectively, protrude towards the center of discharge cells 133 from an outer side of each of the discharge cells 133. Accordingly, the cross-talk effect caused by the first barrier members 30 defining the discharge cells 133 neighboring in the second direction x can be effectively prevented.

Phosphor layers 112 are formed with the lateral sides of the first barrier members 30, the lateral sides of the second barrier members 130*b* defining the discharge cells 133, and a phosphor material applied on the first dielectric layer 13 surrounded by the first and second barrier members 30 and 130*b*.

A second dielectric layer 123 formed on the front substrate 20 includes grooves at the locations in correspondence with of the barrier ribs 130. For example, the grooves may be correspondingly disposed at locations of the second barrier ribs 130*b*. Horizontal grooves 123*a* are illustrated in the second embodiment, while the vertical grooves 23*a* are illustrated in the first embodiment.

When the barrier ribs 130 are formed only with the first barrier members 30 as described in the first embodiment, only the vertical grooves 23*a* may be formed on the second dielectric layer 23.

When the barrier ribs 130 are formed with both of the first barrier members 30 and the second barrier members 130*b* as described in the second embodiment, only the horizontal grooves 123*a* may be formed thereon.

When the vertical grooves 23*a* and the horizontal grooves 123*a* are formed on the second dielectric layer 123, the horizontal grooves 123*a* may be formed to have the same or greater depths with respect to those of the vertical grooves 23*a*. The horizontal grooves 123*a* are parallel to the sustain electrodes 21 and the scan electrodes 22, and thus not damage these electrodes 21 and 22. This enables each horizontal groove 123*a* to have a depth equal to the thickness of the second dielectric layer 123. That is, the horizontal grooves 123*a* allow the inner surface of the front substrate 20 to be exposed.

In this case, according to a difference in the height of each first barrier member 30 and the height of each second barrier member 130*b*, the horizontal grooves 123*a* may have the same or different depths with respect to the vertical grooves 23*a*.

In the second embodiment, the horizontal grooves 123*a* are formed. This exemplifies that the heights of the second barrier members 130*b* corresponding to the horizontal grooves 123*a* are greater than those of the first barrier members 30.

Accordingly, when the rear substrate 10 and the front substrate 20 are sealed against each other, the second barrier members 130*b* of the rear substrate 10 are respectively joined with the horizontal grooves 123*a* formed on the second dielectric layer 123 of the front substrate 20. The first barrier members 30 are closely adhered to the inner surface of the second dielectric layer 123.

A difference in the tension force of a clip (not shown) is produced in the process of sealing the rear substrate 10 and the front substrate 20. This difference is absorbed according to the depth of insertion when the second barrier members 130*b* are joined with the horizontal grooves 123*a*. Accordingly, the front substrate 20 and the rear substrate 10 are not affected by a distortion effect.

A visible light beam is generated in one discharge cell 133 when ends of the second barrier members 130*b* are buried into the horizontal grooves 123*a* of the second dielectric layer 123. The generated visible light beam is blocked by the second barrier members 130*b*, disabling its passage over the adjacent non-emissive discharge cells 133. Accordingly, the cross-talk effect and the halation effect can be effectively prevented.

The second barrier members 130*b* include second black layers 32 to improve contrast. In the second embodiment, the first black layers of the first barrier members 30 are not illustrated. That is, when the barrier ribs 130 are composed of the first barrier members 30 and the second barrier members 130*b*, either the second black layers 32 may be provided, or both of the first and second black layers 31 and 32 may be provided.

When the second barrier members 130*b* are inserted into the horizontal grooves 123*a*, the second black layers 32 are located adjacent to the front substrate 20 within the horizontal grooves 123*a*. The second black layers 32 may be closely adhered to the front substrate 20 within the horizontal grooves 123*a*. When the second black layers 32 are closely adhered to the front substrate 20, external light can be more effectively absorbed than when the second black layers 32 are separated from the front substrate 20. Therefore, contrast can be further improved.

When both of the first and second black layers 31 and 32 are provided, the first black layers 31 are closely adhered to the second dielectric layer 123 in a state that the second barrier members 130*b* are inserted into the horizontal grooves 123*a*. When the first black layers 31 and the second black layers 32 are both formed on a non-emissive region of the front substrate 10 while forming a matrix structure, contrast may be more improved than when the first black layers 31 or the second black layers 32 are independently formed.

Figure 7:
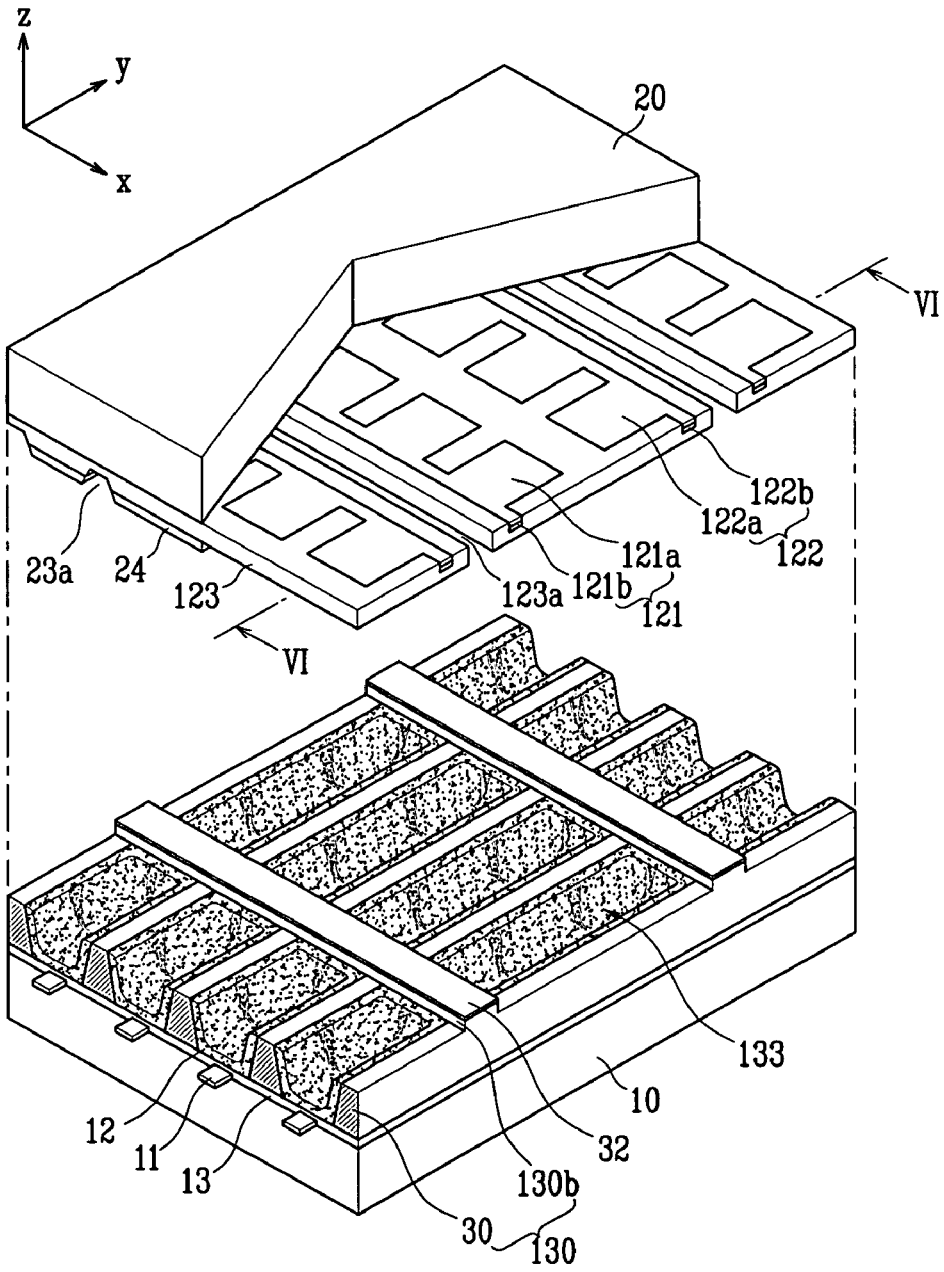
FIG. 7 is a perspective view of a PDP having horizontal and vertical grooves according to a second embodiment.

Although it has been described that the PDP according to the second embodiment includes the horizontal grooves 123*a*, the present embodiments are not limited thereto. That is, as shown in FIG. 7, the PDP according to the second embodiment may include the vertical grooves 23*a* corresponding to the first barrier members 30 together with the horizontal groves 123*a* corresponding to the second barrier members 130*b*.

Figure 8:
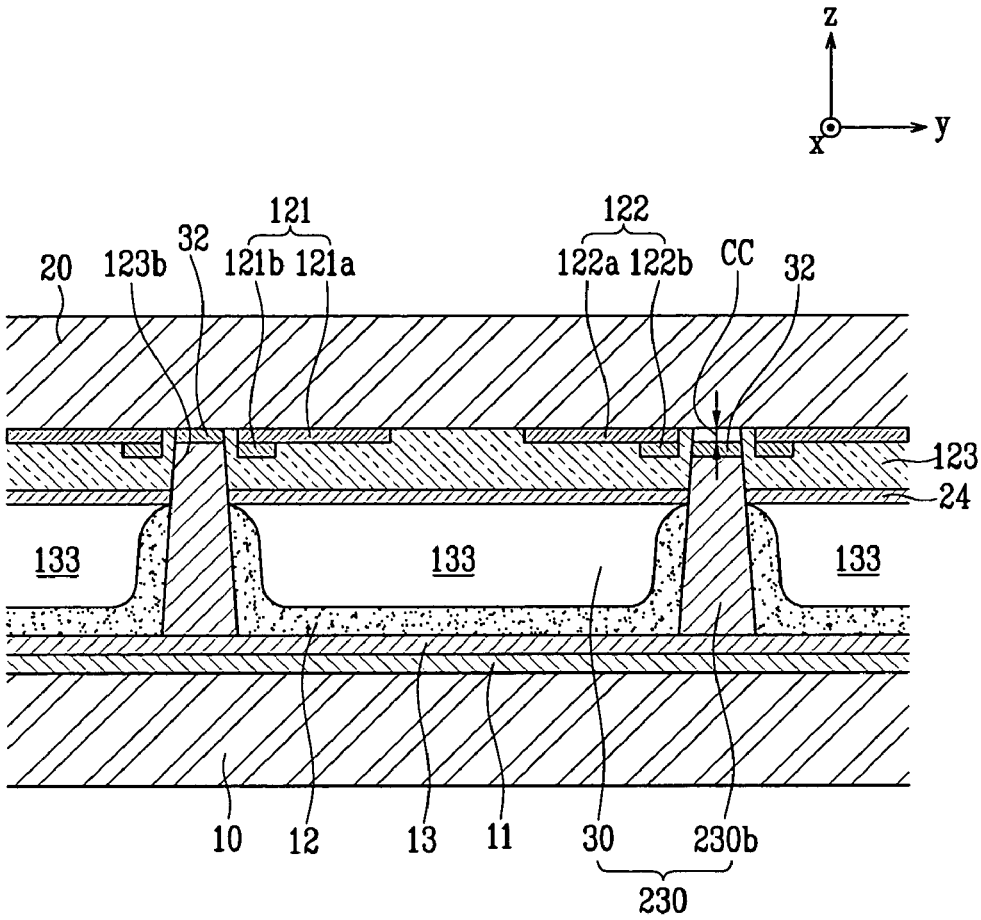
FIG. 8 is a cross-sectional view of a PDP according to a third embodiment.

FIG. 8 is a cross-sectional view of a PDP according to a third embodiment.

The third embodiment is a modification of the second embodiment. Thus, only differences from the second embodiment will be described. In the third embodiment, barrier ribs 230 respectively have different heights. For example, second barrier members 230*b* are formed to have different heights from one another.

Accordingly, when the second barrier members 230*b* are joined with horizontal grooves 123*a*, ends of relatively higher second barrier members 230*b* (left barrier member of FIG. 7) are closely adhered to the inner side of the front substrate 20, whereas ends of relatively lower second barrier members 230*b* (right barrier member of FIG. 7) are separated from the inner side of the front substrate 20.

Specifically, the second black layers 32 included in the second barrier members 230*b* may be closely adhered to the front substrate 10 or may be separated from the front substrate 10. That is, a gap CC is formed between the second black layers 32 and the front substrate 10 separated from each other.

According to a plasma display panel of the present embodiments, grooves are formed on portions in correspondence with barrier ribs in a dielectric layer covering first electrodes and second electrodes, and the barrier ribs are joined with the grooves. The grooves thus absorb a difference in the tension force of a clip that bonds the grooves to both substrates, thereby protecting a rear substrate or a front substrate against distortion. Further, ends of the barrier ribs located within the grooves block a visible light beam emitted from an emissive discharge cell, thereby disabling its passage over a non-emissive discharge cell. Therefore, a halation effect can be reduced.

In addition, according to the present embodiments, the barrier ribs are joined with the grooves regardless of height deviations of the barrier ribs and the difference in the tension force, thereby advantageously preventing a cross-talk effect between neighboring discharge cells. Further, black layers are provided to the barrier ribs inserted into the grooves, thereby improving contrast.

Although the exemplary embodiments and the modified examples of the present embodiments have been described, the present embodiments are not limited to the embodiments and examples, but may be modified in various forms without departing from the scope of the appended claims, the detailed description, and the accompanying drawings of the present embodiments. Therefore, it is natural that such modifications belong to the scope of the present embodiments.

What is claimed is:

1. A plasma display panel comprising:

a first substrate and a second substrate facing each other;

address electrodes formed on the first substrate extending in a first direction;

barrier ribs disposed between the first and second substrates, configured to define discharge cells;

phosphor layers formed within the discharge cells;

first electrodes and second electrodes formed on the second substrate extending in a second direction crossing the first direction; and a dielectric layer configured to cover the first electrode and the second electrode, wherein the dielectric layer includes grooves, and at least one portion of the barrier ribs is inserted into the grooves;

wherein the barrier ribs comprise black layers located within the grooves; and wherein the black layers are adhered to and directly in contact with the second substrate.

2. The plasma display panel of claim 1, wherein the grooves comprise first grooves that extend in a first direction and second grooves that extend in a second direction.

3. The plasma display panel of claim 1, wherein the grooves include second grooves each having a predetermined depth.

4. The plasma display panel of claim 3, wherein the barrier ribs comprise:

first barrier members extending in the first direction; and second barrier members extending in the second direction between the first barrier members.

5. The plasma display panel of claim 4, wherein the second grooves extend in the second direction.

6. The plasma display panel of claim 4, wherein the barrier ribs comprise second black layers located within the second grooves.

7. The plasma display panel of claim 6, wherein the second black layers are adhered to and directly in contact with the first substrate.

8. The plasma display panel of claim 4, wherein each of the second grooves has a depth substantially equal to the thickness of the dielectric layer.

9. The plasma display panel of claim 4, wherein the heights of the second barrier members are greater than the heights of the first barrier members.

10. The plasma display panel of claim 1, wherein the grooves include:

first grooves each having a depth smaller than the thickness of the dielectric layer; and second grooves each having a depth greater than the depths of the first grooves.

11. The A method of manufacturing the plasma display panel of claim 1, comprising:

providing the first and second substrate;

providing the barrier ribs;

providing the dielectric layer; and combining the first and second substrate such that the at least one portion of the barrier ribs is inserted into the grooves of the dielectric layer.

* * * * *